US011232733B2

(12) United States Patent
Park et al.

(10) Patent No.: US 11,232,733 B2
(45) Date of Patent: Jan. 25, 2022

(54) DISPLAY APPARATUS AND METHOD OF DRIVING DISPLAY PANEL USING THE SAME

(71) Applicant: Samsung Display Co., LTD., Yongin-si (KR)

(72) Inventors: Soonnyung Park, Incheon (KR); Sungbae Park, Busan (KR); Sangyoon Lee, Pohang-si (KR); Seongyun Lee, Incheon (KR); Hyeseon Choi, Busan (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/825,287

(22) Filed: Mar. 20, 2020

(65) Prior Publication Data

US 2020/0388203 A1 Dec. 10, 2020

(30) Foreign Application Priority Data

Jun. 4, 2019 (KR) ..... 10-2019-0066251

(51) Int. Cl.
*G09G 3/20* (2006.01)

(52) U.S. Cl.
CPC ..... *G09G 3/20* (2013.01); *G09G 2320/028* (2013.01); *G09G 2320/0238* (2013.01)

(58) Field of Classification Search
CPC .. G09G 3/20; G09G 3/3625; G09G 2320/028; G09G 2320/0238; G09G 2320/068; G09G 2310/0208; G09G 2310/0213; G09G 2310/04
See application file for complete search history.

(56) References Cited

U.S. PATENT DOCUMENTS

| | | | | |
|---|---|---|---|---|
| 6,961,029 | B1 | 11/2005 | Canova, Jr. et al. | |
| 10,073,848 | B2 | 9/2018 | Kluckner et al. | |
| 2014/0168126 | A1* | 6/2014 | Yu | G06F 3/04886 345/173 |
| 2016/0342327 | A1* | 11/2016 | Chi | G06F 3/04883 |
| 2018/0366058 | A1* | 12/2018 | Gu | G09G 3/20 |

FOREIGN PATENT DOCUMENTS

| | | |
|---|---|---|
| KR | 10-2008-0082040 | 9/2008 |
| KR | 10-2018-0091839 | 8/2018 |

* cited by examiner

*Primary Examiner* — Kenneth Bukowski
(74) *Attorney, Agent, or Firm* — Kile Park Reed & Houtteman PLLC

(57) ABSTRACT

A display includes a window, a display panel and a display panel driver. The display panel includes an active area and a spare area around the active area. The active area includes pixels. The spare area includes spare pixels which are selectively activated to compensate for an amount of tilt of the active area.

20 Claims, 11 Drawing Sheets

DISPLAY APPARATUS AND METHOD OF DRIVING DISPLAY PANEL USING THE SAME

CROSS-REFERENCE TO RELATED APPLICATION

This application claims priority to and benefits of Korean Patent Application No. 10-2019-0066251 under 35 U.S.C. § 119, filed in the Korean Intellectual Property Office on Jun. 4, 2019, the entire contents of which are incorporated herein by reference.

BACKGROUND

1. Technical Field

Embodiments of the disclosure relate to a display apparatus and a method of driving a display panel using the display apparatus. More particularly, embodiments of herein relate to a display apparatus including a display panel including a spare area in which spare pixels are disposed to compensate a misalignment between a window and the display panel of the display apparatus.

2. Description of the Related Art

A display apparatus may include a display panel and a display panel driver. The display panel may include gate lines, data lines and pixels. The display panel driver may include a gate driver, a data driver and a driving controller. The gate driver may output gate signals to the gate lines. The data driver may output data voltages to the data lines. The driving controller may control the gate driver and the data driver. The display apparatus may include a window disposed on the display panel that may define a viewing area.

In a case that the window and the display panel may not be aligned accurately during a method of manufacturing the display apparatus, a misalignment, i.e., a tilt defect, between the window and the display panel may occur. The tilt defect may be regarded as a case in which a center of the viewing area of the window may not be overlapped with or faced with a center of an active area of the display panel, i.e., the center of the viewing area is offset from the center of an active area in one or both of a horizontal direction and a vertical direction such that there is a non-zero distance between the center of the viewing area and the center of the active area.

SUMMARY

Embodiments of the disclosure provide a display apparatus including a display panel including a spare area in which spare pixels are disposed to compensate a misalignment or tilt defect between the window and the display panel.

Embodiments of the disclosure provide a method of driving a display panel using the above-mentioned display apparatus.

In an embodiment, the display apparatus may include a window, a display panel and a display panel driver. The display panel may include an active area and a spare area around the active area. The active area may include pixels. The spare area may include spare pixels which may be selectively activated.

An amount of the selectively activated pixels may correspond to an amount of tilt between respective centers of the active area and a viewing area of the display panel defined by the window.

The display apparatus may include a light blocking portion disposed along the window and that may define a viewing area of the display panel.

The active area and an activated portion of the spare area may form a compensated active area. The compensated active area may be disposed in the viewing area of the display panel.

A portion of the spare area may be disposed outside of the viewing area of the display panel.

The compensated active area may be defined in a case that the display apparatus may be driven. The compensated active area may be generated by activating the activated portion of the spare area forming the compensated active area to shift the active area in a horizontal direction and shift the active area in a vertical direction.

The viewing area may have a circular shape. The active area may have a circular shape. An area of the display panel, which may be a sum of the active area and the spare area, may have a circular shape.

The viewing area may have a polygonal shape. The active area may have a polygonal shape. An area of the display panel, which may be a sum of the active area and the spare area, may have a polygonal shape.

The display panel driver may be disposed outside of the spare area. The display panel driver may include a gate driver configured to output a gate signal to the display panel and a data driver configured to output a data voltage to the display panel.

A compensated spare area defining an area around the compensated active area may be formed in response to formation of the compensated active area and may be configured to display a black image.

The gate driver may be configured to output the gate signal to the compensated active area and the compensated spare area. The data driver may be configured to output a target data voltage to the compensated active area and a black data voltage to the compensated spare area.

A compensated spare area defining an area around the compensated active area may include vertical compensated spare areas corresponding to upper and lower portions of the compensated spare area and a horizontal spare area excluding the vertical compensated spare areas of the compensated spare area. The spare pixels in the vertical compensated spare areas may be turned off. The spare pixels in the horizontal compensated spare area may be turned on to display a black image.

The gate driver may be configured to output the gate signal from an uppermost portion of the compensated active area to a lower most portion of the compensated active area.

In an embodiment, a method of driving a display panel may include displaying an image in an active area, determining an amount of tilt of the active area based on a distance between a viewing area and the active area and selectively activating a plurality of spare pixels disposed in a spare area around the active area based on the amount of tilt of the active area. The active area may include pixels. The viewing area may be defined by a light blocking portion disposed along a window around the viewing area.

The active area and an activated portion of the spare area may form a compensated active area. The compensated active area may be disposed in the viewing area.

A portion of the spare area may be disposed outside of the viewing area.

The determining the amount of tilt of the active area may include determining an amount of horizontal tilt of the active area in a horizontal direction and determining an amount of vertical tilt of the active area in a vertical direction. The compensated active area may be generated by activating the activated portion of the spare area forming the compensated active area to shift the active area in the horizontal direction and shift the active area in the vertical direction.

A compensated spare area defining an area around the compensated active area may be formed in response to formation of the compensated active area and configured to display a black image.

A gate driver may be configured to output the gate signal to the compensated active area and the compensated spare area. A data driver may be configured to output a target data voltage to the compensated active area and a black data voltage to the compensated spare area.

A compensated spare area defining an area around the compensated active area may include vertical compensated spare areas corresponding to upper and lower portions of the compensated spare area and a horizontal spare area excluding the vertical compensated spare areas of the compensated spare area. The spare pixels in the vertical compensated spare areas may be turned off. The spare pixels in the horizontal compensated spare area may be turned on to display a black image.

A gate driver may be configured to output the gate signal from an uppermost portion of the compensated active area to a lower most portion of the compensated active area.

According to the display apparatus and the method of driving the display panel using the display apparatus, the display panel may include the spare area around the active area and the spare pixels which may be selectively activated. Thus, a margin or an amount of the spare pixels to compensate the misalignment between the window and the active area may be obtained using the spare pixels of the spare area in a case that the window and the active area may not be aligned accurately.

Thus, the misalignment (or the tilt defect) between the window and the active area may be compensated so that the reliability of the display apparatus may be enhanced and the number of the discarded display apparatuses overly affected by the misalignment may be minimized so that an overall cost of the display apparatus may be reduced.

BRIEF DESCRIPTION OF THE DRAWINGS

The above and other features and advantages of the disclosure will become more apparent by describing embodiments thereof with reference to the accompanying drawings, in which.

DETAILED DESCRIPTION OF THE EMBODIMENTS

Figure 1:
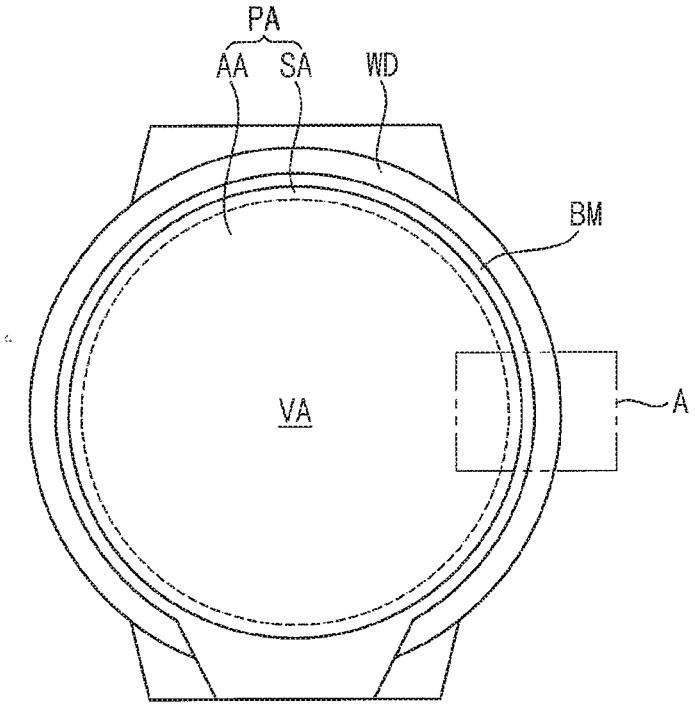
FIG. 1 shows a plan view illustrating a display apparatus according to an embodiment.

Hereinafter, embodiments will be explained in detail with reference to the accompanying drawings.

Parts that are irrelevant to the description will be omitted to clearly describe the disclosure, and like reference numerals designate like elements throughout the description.

Further, in the drawings, the size and thickness of each element may be arbitrarily illustrated for ease of description, but the disclosure may not be necessarily limited to those embodiments illustrated in the drawings. In the drawings, the thicknesses of layers, films, panels, regions, etc., may be exaggerated for clarity.

It will be understood that when an element such as a layer, film, region, or substrate is referred to as being "on" another element, it may be directly on the other element or intervening elements may also be present. In contrast, when an element is referred to as being "directly on" another element, there may be no intervening elements present. The word "over" or "on" means positioning on or below an object portion, and does not necessarily mean positioning on the upper side of the object portion based on a gravity direction.

Unless explicitly described to the contrary, the word "comprise" and variations such as "comprises" or "comprising" will be understood to imply the inclusion of stated elements but not the exclusion of any other elements. As used herein, the term "and/or" may include any and all combinations of one or more of the associated listed items. Expressions such as "at least one of," when preceding a list of elements, modify the entire list of elements and do not modify the individual elements of the list. As used herein, the term "and/or" may include any and all combinations of one or more of the associated listed items. Expressions such as "at least one of," when preceding a list of elements, modify the entire list of elements and do not modify the individual elements of the list.

In a case that a certain embodiment may be implemented differently, a specific process order may be performed differently from the described order. For example, two consecutively described processes may be performed substantially at the same time or performed in an order opposite to the described order.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within, for example, ±30%, 20%, or 5% of the stated value.

It will be understood that the terms "first," "second," etc. may be used herein to describe various components, these components should not be limited by these terms. These terms may only be used to distinguish one component from another.

As used herein, the singular forms "a," "an," and "the" are intended to include the plural forms as well, unless the context clearly indicates otherwise.

In the embodiments hereinafter, it will be understood that when an element, an area, or a layer is referred to as being connected to another element, area, or layer, it can be directly or indirectly connected to the other element, area, or layer. For example, it will be understood in this description that when an element, an area, or a layer is referred to as being in contact with or being electrically connected to another element, area, or layer, it may be directly or indirectly in contact with or electrically connected to the other element, area, or layer.

Further, the phrase "in a plan view" means when an object portion is viewed from above, and the phrase "in a cross-sectional view" means when a cross-section taken by vertically cutting an element portion is viewed from the side. Additionally, the terms "overlap" or "overlapped" mean that a first object may be above or below or to a side of a second object, and vice versa. Additionally, the term "overlap" may include layer, stack, face or facing, extending over, covering or partly covering or any other suitable term as would be appreciated and understood by those of ordinary skill in the art. The terms "face" and "facing" mean that a first element may directly or indirectly oppose a second element. In a case in which a third element intervenes between the first and second element, the first and second element may be understood as being indirectly opposed to one another, although still facing each other. When an element is described as 'not overlapping' or 'to not overlap' another element, this may include that the elements are spaced apart from each other, offset from each other, or set aside from each other or any other suitable term as would be appreciated and understood by those of ordinary skill in the art. When a layer, region, substrate, or area, is referred to as being "on" another layer, region, substrate, or area, it may be directly on the other region, substrate, or area, or intervening regions, substrates, or areas, may be present therebetween. Conversely, when a layer, region, substrate, or area, is referred to as being "directly on" another layer, region, substrate, or area, intervening layers, regions, substrates, or areas, may be absent therebetween. Further when a layer, region, substrate, or area, is referred to as being "below" another layer, region, substrate, or area, it may be directly below the other layer, region, substrate, or area, or intervening layers, regions, substrates, or areas, may be present therebetween. Conversely, when a layer, region, substrate, or area, is referred to as being "directly below" another layer, region, substrate, or area, intervening layers, regions, substrates, or areas, may be absent therebetween. Further, "over" or "on" may include positioning on or below an object and does not necessarily imply a direction based upon gravity.

The spatially relative terms "below", "beneath", "lower", "above", "upper", or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in other directions and thus the spatially relative terms may be interpreted differently depending on the orientations.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the description.

Figure 2:
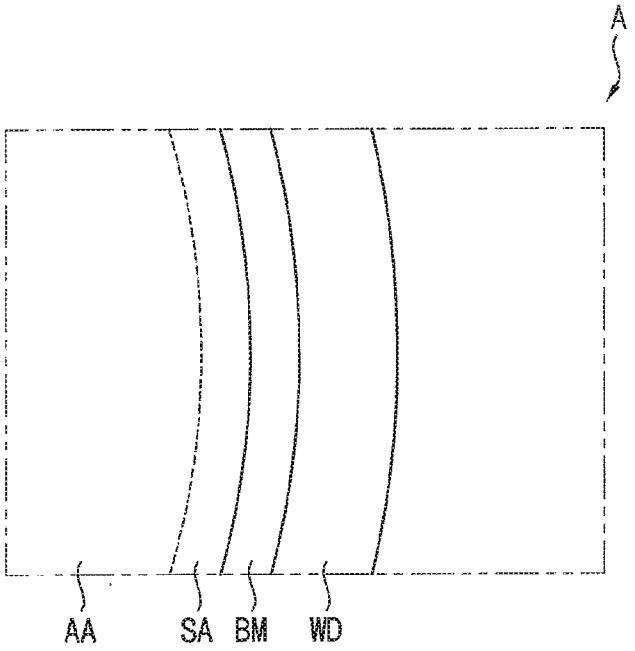
FIG. 2 shows a plan view illustrating a portion A.
Figure 3:
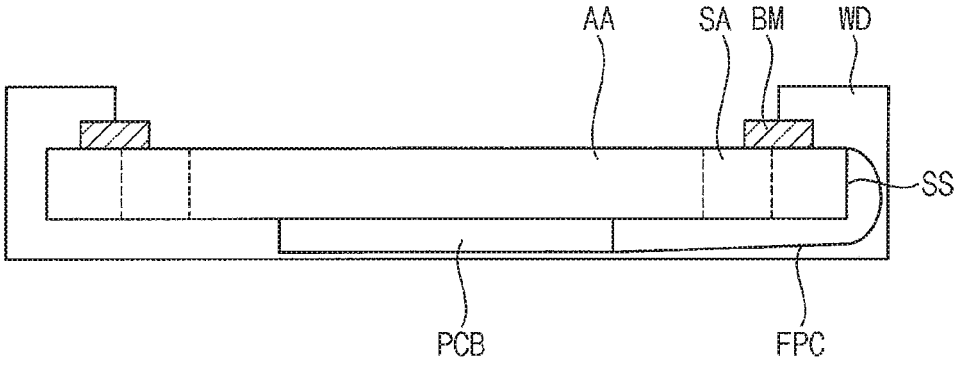
FIG. 3 shows a schematic cross-sectional view illustrating the display apparatus of FIG. 1.

FIG. 1 shows a plan view illustrating a display apparatus according to an embodiment. FIG. 2 shows a plan view illustrating a portion A. FIG. 3 shows a schematic cross-sectional view illustrating the display apparatus of FIG. 1.

Referring to FIGS. 1 to 3, the display apparatus may include a circular display panel. For example, the display apparatus may be a smart watch.

The display apparatus may include a window WD and a display panel disposed beneath the window WD. The display apparatus may further include a light blocking portion BM disposed along an inner circumference of the window WD. A viewing area VA may be defined by the window WD or the light blocking portion BM. That is, the viewing area VA may be delimited by the window WD and/or the light blocking portion BM.

The display panel includes a pixel area PA. The pixel area PA may include an active area AA and a spare area SA surrounding or around a periphery of the active area AA. The active area AA may include pixels.

The spare area SA may include spare pixels. The spare pixels may be selectively activated. A portion of the spare area SA may be disposed outside of the viewing area VA.

The light blocking portion BM may block an image displayed on the active area AA and the spare area SA of the display panel such that the image may not be shown to a user.

The viewing area VA may include a circular shape. The active area AA may include a circular shape. The pixel area PA, which may represent a sum of the active area AA and the spare area SA, may include a circular shape. For example, outermost lines of the active area AA and the spare area SA may each be a circle.

In FIGS. 1 to 3, the viewing area VA of the window WD and the active area AA of the display panel may be accurately aligned.

In a case that the viewing area VA of the window WD and the active area AA of the display panel may be accurately aligned. The spare area SA may surround or be around a periphery of the active area AA. The light blocking portion BM may surround or be around a periphery of a portion of the spare area SA. The window WD may surround or be around a periphery of the light blocking portion BM.

In a case that the viewing area VA of the window WD and the active area AA of the display panel may be accurately aligned, the light blocking portion BM may be disposed between the window WD and the spare area SA in a plan view.

The display panel may include a display substrate SS. A display panel driver driving the display panel may be disposed on a printed circuit board PCB. The display panel driver may be disposed outside of the spare area SA. The printed circuit board PCB may be connected to the display substrate SS through a flexible printed circuit FPC. A central portion of the display substrate SS may include the active area AA and an outer portion of the display substrate SS may include the spare area SA.

The light blocking portion BM may include a light blocking material disposed an outer portion of the display substrate SS. The light blocking portion BM may surround or be around a periphery of an outer portion of the spare area SA. The light blocking portion BM may overlap or face the outer portion of the spare area SA.

The window WD may be disposed on the light blocking portion BM. The window WD may surround or be around a periphery of an outer portion of the light blocking portion BM. The window WD may overlap or face the outer portion of the light blocking portion BM.

Figure 4:
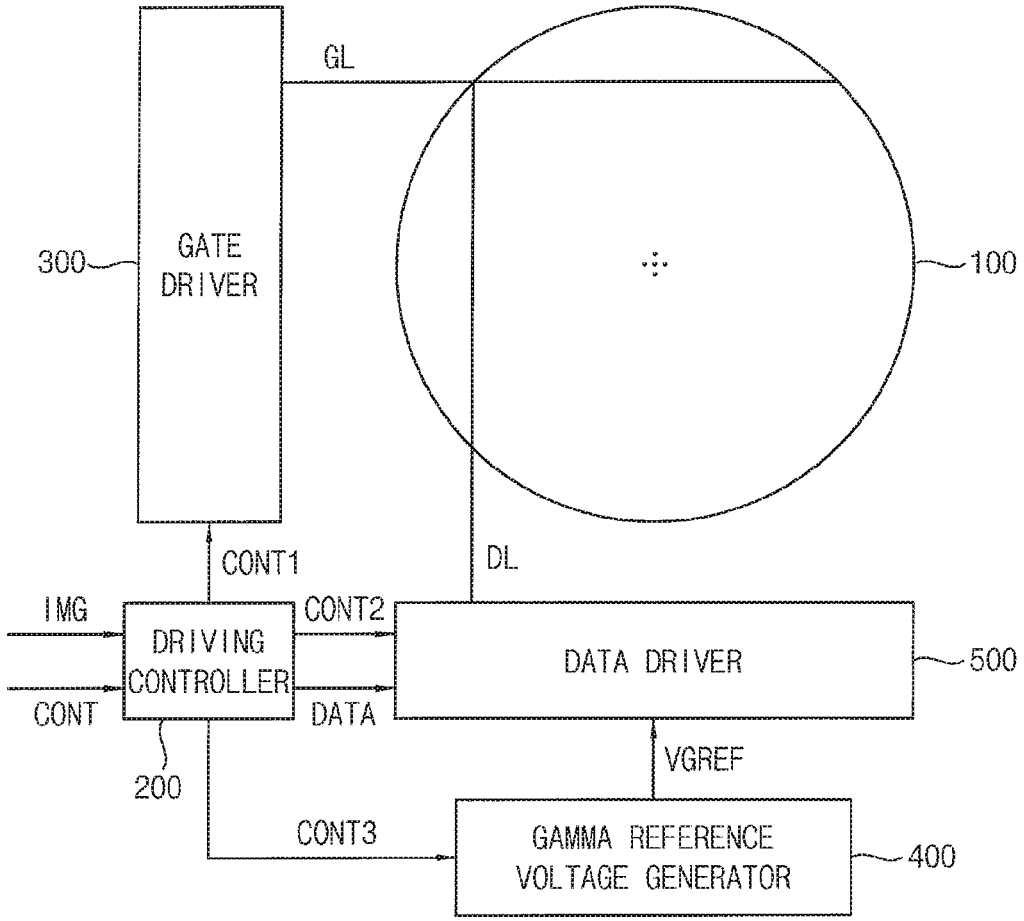
FIG. 4 shows a block diagram illustrating the display apparatus of FIG. 1.

FIG. 4 shows a block diagram illustrating the display apparatus of FIG. 1.

Referring to FIGS. 1 to 4, the display apparatus may include the display panel 100 and the display panel driver. The display panel driver may include a driving controller 200, a gate driver 300, a gamma reference voltage generator 400 and a data driver 500.

The display panel 100 may include a display portion and a peripheral region disposed adjacent to the display portion.

The display portion of the display panel 100 may include the active area AA and the spare area SA surrounding the active area AA.

For example, the display panel 100 may be an organic light emitting diode display panel including organic light emitting diodes. As another example, the display panel 100 may be a liquid crystal display panel including liquid crystal molecules.

The display panel 100 may include gate lines GL, data lines DL and subpixels electrically connected to the gate lines GL and the data lines DL. The gate lines GL may extend in a first direction and the data lines DL may extend in a second direction crossing the first direction.

The driving controller 200 may receive input image data IMG and an input control signal CONT from an external apparatus (not shown). The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, a third control signal CONT3 and a data signal DATA based on the input image data IMG and the input control signal CONT.

The driving controller 200 may generate the first control signal CONT1 for controlling an operation of the gate driver 300 based on the input control signal CONT, and may output the first control signal CONT1 to the gate driver 300. The first control signal CONT1 may include a vertical start signal and a gate clock signal.

The driving controller 200 may generate the second control signal CONT2 for controlling an operation of the data driver 500 based on the input control signal CONT, and may output the second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT, and may output the third control signal CONT3 to the gamma reference voltage generator 400.

The gate driver 300 may generate gate signals driving the gate lines GL in response to the first control signal CONT1 received from the driving controller 200. The gate driver 300 may output the gate signals to the gate lines GL. For example, the gate driver 300 may sequentially output the gate signals to the gate lines GL, be integrated on the display panel 100, and may be mounted on the display panel 100.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to a level of the data signal DATA.

The gamma reference voltage generator 400 may be disposed in the driving controller 200, or in the data driver 500.

The data driver 500 may receive the second control signal CONT2 and the data signal DATA from the driving controller 200, and may receive the gamma reference voltages VGREF from the gamma reference voltage generator 400. The data driver 500 may convert the data signal DATA into data voltages having an analog type using the gamma reference voltages VGREF. The data driver 500 may output the data voltages to the data lines DL.

Figure 5:
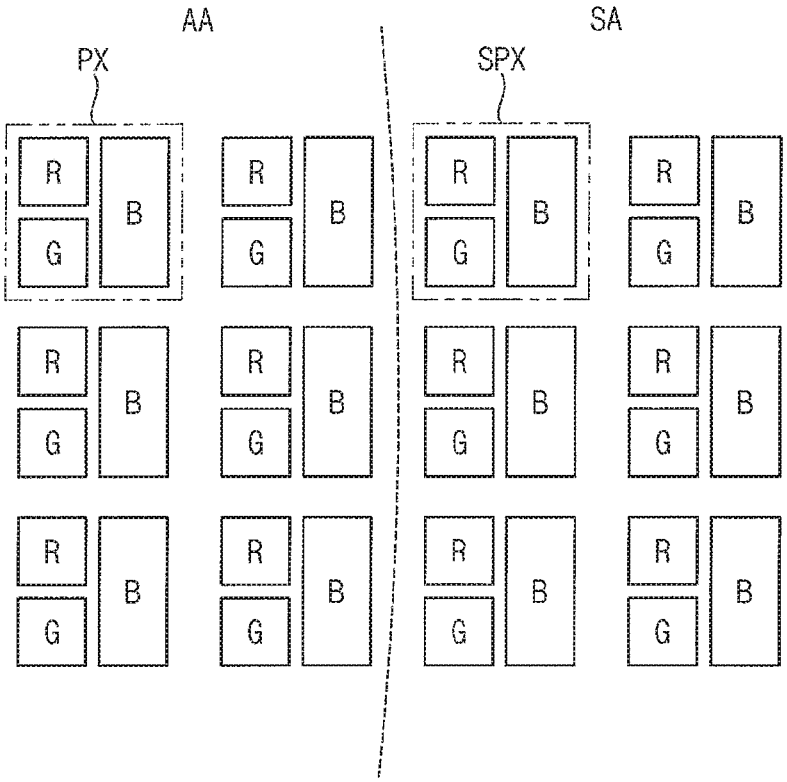
FIG. 5 shows a conceptual diagram illustrating a pixel structure of a display panel of FIG. 4.

FIG. 5 shows a conceptual diagram illustrating a pixel structure of the display panel 100 of FIG. 4.

Referring to FIGS. 1 to 5, the pixels PX may be disposed in the active area AA. The pixel PX may include subpixels SPX. For example, the pixel PX may include a first color subpixel R, a second color subpixel G and a third color subpixel B. The first color subpixel R may be a red color subpixel. The second color subpixel G may be a green color subpixel. The third color subpixel B may be a blue color subpixel.

In the pixel area PX, the second color subpixel G may be disposed under the first color subpixel R. In the pixel area PX, the third color subpixel B may be disposed at a right side of the first color subpixel R and the second color subpixel G. The third color subpixel B may be longer than the first color subpixel R in a vertical direction. The third color subpixel B may be longer than the second color subpixel G in the vertical direction.

The spare pixels SPX may be disposed in the spare area SA. The spare pixel SPX may include subpixels. The pixel structure of a spare pixel SPX may be same as the pixel structure of the pixel PX.

For example, the spare area SA may include three subpixels of the spare pixels SPX in a row direction (i.e., a horizontal direction). For example, the spare area SA may include three of the spare subpixels in a column direction (i.e., a vertical direction).

The active area AA may have a circular shape. For example, the pixels may be formed continuously at an outermost portion of the active area AA so that the outermost line of the active area AA may form a substantially circular shape, including a curved shape.

The spare area SA may have a circular shape. For example, the spare pixels may be formed continuously at an outermost portion of the spare area SA so that the outermost line of the spare area SA may form a substantially circular shape, including a curved shape.

Figure 6:
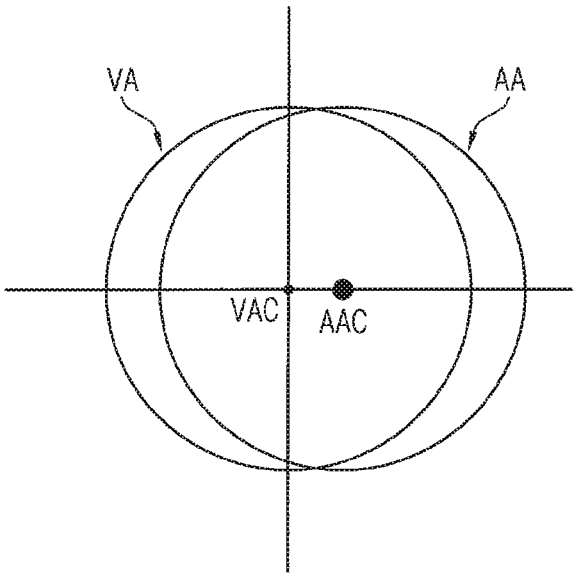
FIG. 6 shows a conceptual diagram illustrating a viewing area and an active area of the display apparatus of FIG. 1.

FIG. 6 shows a conceptual diagram illustrating the viewing area VA and the active area AA of the display apparatus of FIG. 1. In FIG. 6, the viewing area VA of the window WD and the active area AA of the display panel 100 may not be aligned accurately.

Referring to FIG. 6, the active area AA may be tilted in a horizontal direction with respect to the viewing area VA defined by the window WD. Thus, a center VAC of the viewing area VA may not be aligned with the center AAC of the active area AA.

The alignment between the viewing area VA of the window WD and the active area AA of the display panel may be checked by a visual inspection.

An amount of tilt between the viewing area VA of the window WD and the active area AA of the display panel may be accurately measured using a microscope. The amount of tilt of the active area AA may be determined based on a distance between the viewing area VA and the active area AA where the image may be displayed. For example, an amount of horizontal tilt of the active area in the horizontal direction and an amount of vertical tilt of the active area in the vertical direction may be respectively determined.

The amount of horizontal tilt may be determined by using a first distance between the viewing area VA of the window WD and the active area AA at a right side (e.g., a three O'clock position) of the window (WD) and a second distance between the viewing area VA of the window WD and the active area AA at a left side (e.g., a nine O'clock position) of the window (WD). The amount of horizontal tilt may be determined using a greatest value among the first distance and the second distance.

The amount of vertical tilt may be determined by using a third distance between the viewing area VA of the window WD and the active area AA at an upper side (e.g., a twelve O'clock position) of the window (WD) and a fourth distance between the viewing area VA of the window WD and the active area AA at a lower side (e.g., a six O'clock position) of the window (WD). The amount of vertical tilt may be determined by using a greatest value among the third distance and the fourth distance.

Figure 7A:
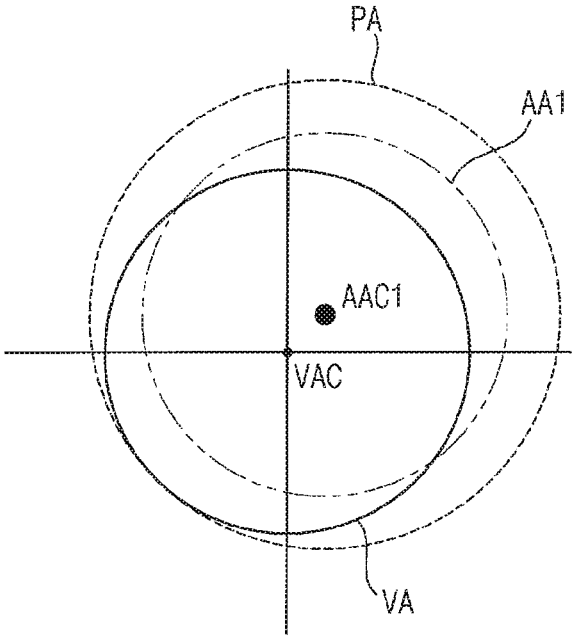
FIG. 7A shows a conceptual diagram illustrating the viewing area and the active area of the display apparatus of FIG. 1 in a case of tilt defect in the display apparatus.
Figure 7B:
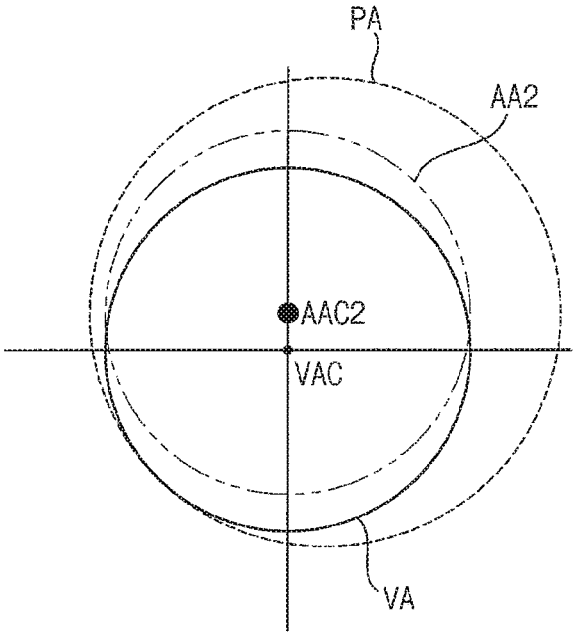
FIG. 7B shows a conceptual diagram illustrating shifting the active area of FIG. 7A in a horizontal direction.
Figure 7C:
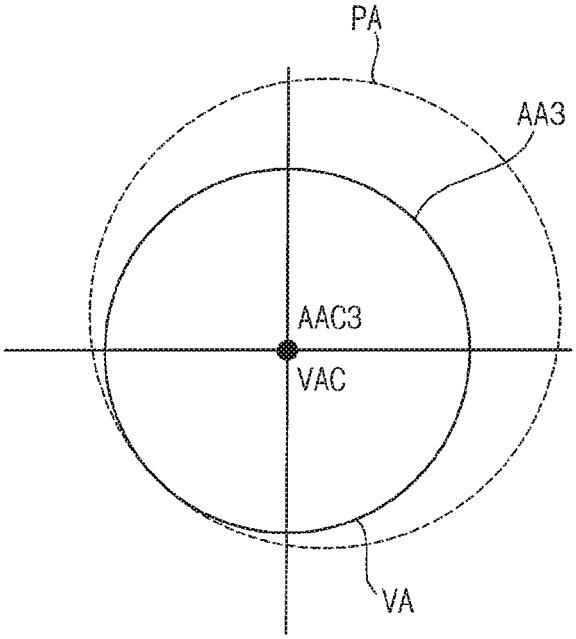
FIG. 7C shows a conceptual diagram illustrating shifting the active area of FIG. 7B in a vertical direction.

FIG. 7A shows a conceptual diagram illustrating the viewing area VA and the active area AA1 of the display apparatus of FIG. 1 in a case that the tilt defect may occur in the display apparatus. FIG. 7B shows a conceptual diagram illustrating shifting of the active area AA1 of FIG. 7A in the horizontal direction. FIG. 7C shows a conceptual diagram illustrating shifting of the active area AA2 of FIG. 7B in the vertical direction.

Referring to FIG. 7A, the viewing area VA of the window WD and the active area AA1 of the display panel 100 may not be aligned accurately, such that the active area AA1 of the display panel 100 may be tilted with respect to the viewing area VA of the window WD in a rightward and upper direction.

The active area AA1 may be disposed at a central portion of the pixel area PA of the display panel 100. In a case that the active area AA1 may display an image, the amount of tilt, including the horizontal and vertical amounts thereof, of the active area AA1 with respect to the viewing area VA may be determined.

In FIG. 7B, the active area AA1 may be shifted in the horizontal direction based on the amount of horizontal tilt of the active area AA1. The horizontal tilt may be compensated, and represented by the shifted active area AA2. However, the shifted active area AA2 may still have the vertical tilt.

Thus, the center of the active area AA1 may be shifted from AAC1 to AAC2.

In FIG. 7C, the shifted active area AA2 may shifted in the vertical direction based on an amount of the vertical tilt of the active area AA1. The vertical tilt may be compensated, and represented by the shifted active area AA3, so that the shifted active area AA3 may be disposed in the viewing area VA.

Thus, the center of the active area AA1 may be shifted from AAC2 to AAC3 so that the center AAC3 of the active area AA3 may be as aligned with the center VAC of the viewing area VA.

Figure 8A:
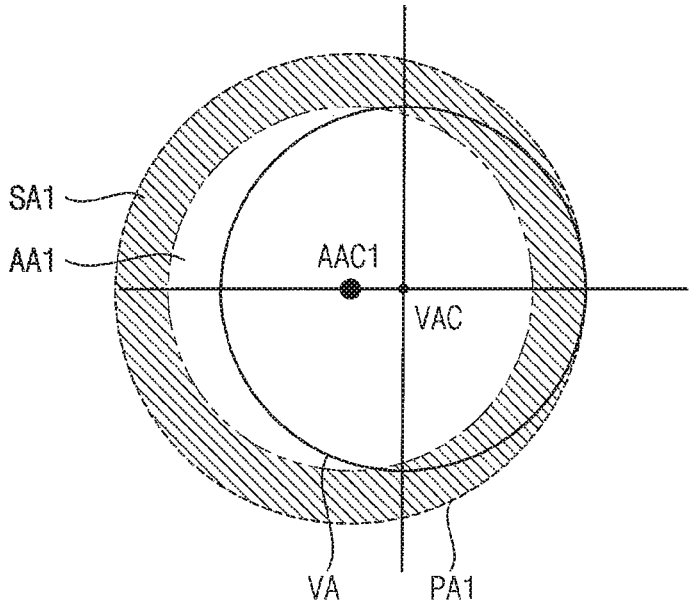
FIG. 8A shows a conceptual diagram illustrating the viewing area and the active area of the display apparatus of FIG. 1 in a case of tilt defect in the display apparatus.
Figure 8B:
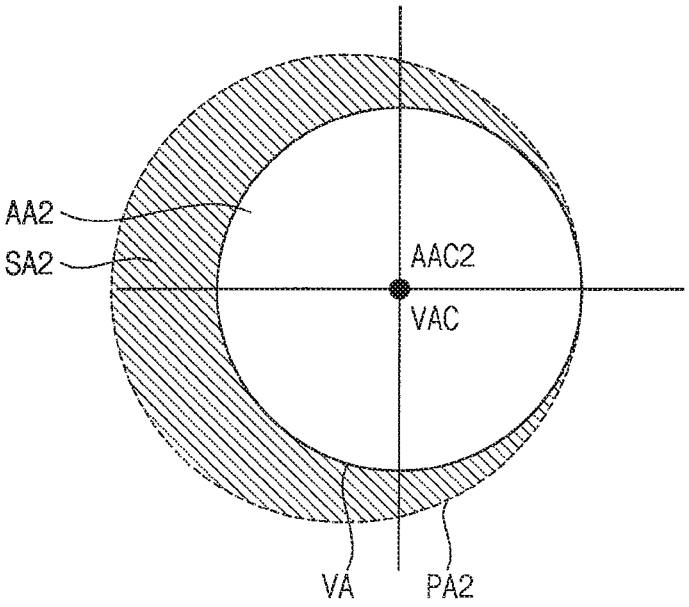
FIG. 8B shows a conceptual diagram illustrating the viewing area and the active area of the display apparatus in a case in which the tilt defect in FIG. 8A may be compensated.

FIG. 8A shows a conceptual diagram illustrating the viewing area VA and the active area AA1 of the display apparatus of FIG. 1 in a case that the tilt defect may occur in the display apparatus. FIG. 8B shows a conceptual diagram illustrating the viewing area VA and the active area AA2 of the display apparatus in a case that the tilt defect in FIG. 8A may be compensated.

As shown in FIG. 8A, the viewing area VA of the window WD and the active area AA1 of the display panel 100 may not be aligned accurately, such that the active area AA1 of the display panel 100 may be tilted with respect to the viewing area VA of the window WD in a leftward direction.

The pixel area PA1 of the display panel 100 may include the active area AA1 and a spare area SA1 surrounding or around a periphery of the active area AA1. The active area AA1 may display a test image and the spare area SA1 may display a black image to determine the amount of tilt of the active area AA1.

As shown in FIG. 8B, the active area AA1 may be shifted in a rightward direction in the viewing area VA so that the tilt of the active area AA1 may be compensated. The pixel area PA2 in FIG. 8B may be same as the pixel area PA1 in FIG. 8A. However, the compensated active area AA2 in FIG. 8B may be different from the active area AA1 in FIG. 8A which represents the active AA1 before compensation occurs, and the compensated spare area SA2 in FIG. 8B may be different from the spare area SA1 in FIG. 8A which represents the spare area SA1 before compensation occurs. The compensated spare area SA2 may be defined as an area surrounding the compensated active area AA2, and may be formed in response to formation of the compensated active area AA2. In other words, one or more portions of the spare area SA1 may be selectively activated to contribute to a shift of the active area AA1, as is represented by the compensated active area AA2 and the compensated spare area SA2. This way, the shift of the active area AA1 from a position thereof as shown in FIG. 8A to a position thereof as shown in FIG. 8B may be achieved.

A portion of the active area AA1 in FIG. 8A, which may be a portion of the active area AA1 before compensation occurs, may be contributed to or added to the compensated spare area SA2 in FIG. 8B so as to achieve the compensated spare area SA2. A portion of the spare area SA1 in FIG. 8A, which may be a portion of the spare area SA1 before compensation occurs, may be contributed to or added to the compensated active area AA2 in FIG. 8B so as to achieve the compensated active area AA2. In view of the above, an amount of selectively activated pixels of the spare area SA1 may correspond to an amount of tilt between the active area AA1 and the viewing area VA so as compensate for the amount of tilt and achieve the compensated spare area SA2 and the compensated active area AA2.

The compensated spare area SA2 may be defined as the area surrounding the compensated active area AA2 and may display the black image. For example, the black image displayed on the compensated spare area SA2 may not be visually distinguished from the light blocking portion BM of FIG. 1. Thus, in a case that the light blocking portion BM includes a dark gray color, the light blocking portion BM may display a dark gray image.

To display the black image, the gate driver 300 may output the gate signal both to the compensated active area AA2 and the compensated spare area SA2 and the data driver 500 may output a target data voltage to the compensated active area AA2 and a black data voltage to the compensated spare area SA2.

According to the embodiment, the display panel 100 may include the spare area SA surrounding or around a periphery of the active area AA and the spare area SA may include spare pixels SPX which may be selectively activated. Thus, a margin or amount of spare pixels SPX which may compensate the misalignment between the window and the active area may be obtained using the spare pixels SPX in a case that the window WD and the active area AA may not be aligned accurately.

Thus, a misalignment between the window WD and the active area AA may be compensated so that the reliability of the display apparatus may be enhanced and the number of the discarded display apparatuses overly affected by the misalignment may be minimized so that an overall cost of manufacturing the display apparatus may be reduced.

Figure 9A:
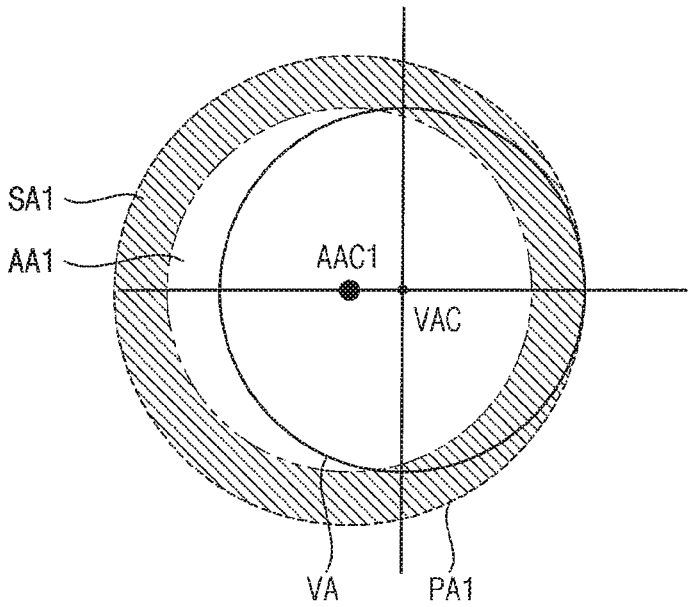
FIG. 9A shows a conceptual diagram illustrating a viewing area and an active area of a display apparatus according to an embodiment in a case of tilt defect in the display apparatus.
Figure 9B:
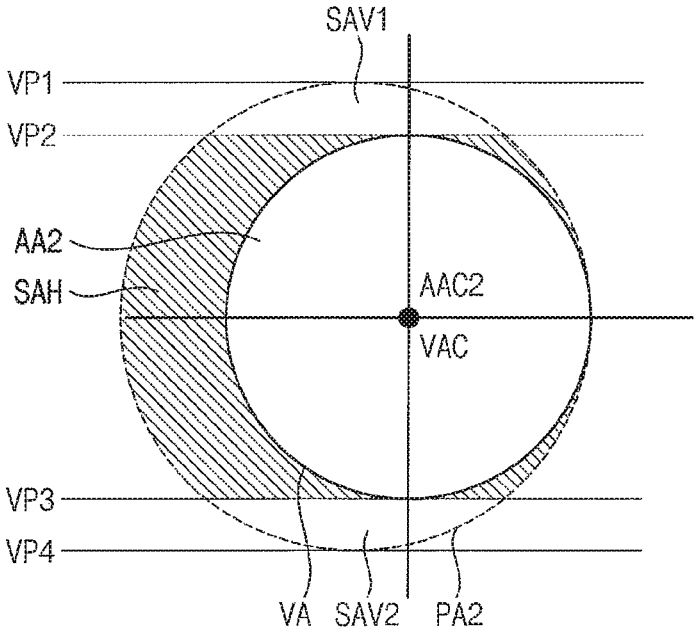
FIG. 9B shows a conceptual diagram illustrating the viewing area and the active area of the display apparatus in a case that the tilt defect in FIG. 9A may be compensated.

FIG. 9A shows a conceptual diagram illustrating a viewing area and an active area of a display apparatus according to an embodiment in a case that the tilt defect occurs in the display apparatus. FIG. 9B shows a conceptual diagram illustrating the viewing area and the active area of the display apparatus in a case that the tilt defect in FIG. 9A may be compensated.

The display apparatus and the method of driving the display panel according to the embodiment may be substantially the same as the display apparatus and the method of driving the display panel of the previous embodiment explained referring to FIGS. 1 to 8B except that a method of deactivating the compensated spare area may be provided.

Referring to FIGS. 1 to 7C, 9A and 9B, the display apparatus may include a circular display panel. For example, the display apparatus may be a smart watch.

The display apparatus may include a window WD and a display panel. A viewing area VA may be defined by the window WD.

The display panel may include a pixel area PA. The pixel area PA may include an active area AA and a spare area SA surrounding or around a periphery of the active area AA. The active area AA may include the pixels PX. The spare area SA may include the spare pixels SPX.

The display apparatus may include the display panel 100 and the display panel driver. The display panel driver may include the driving controller 200, the gate driver 300, the gamma reference voltage generator 400 and the data driver 500.

As shown in FIG. 9A, the viewing area VA of the window WD and the active area AA1 of the display panel 100 may not be aligned accurately, such that the active area AA1 of the display panel 100 may be tilted with respect to the viewing area VA of the window WD in a leftward direction.

The pixel area PA1 of the display panel 100 may include the active area AA1 and a spare area SA1 surrounding or around a periphery of the active area AA1. The active area AA1 may display a test image and the spare area SA1 may display a black image to determine an amount of tilt of the active area AA1.

As shown in FIG. 9B, the active area AA1 may be shifted in a rightward direction in the viewing area VA so that the amount of tilt of the active area AA1 may be compensated. The pixel area PA2 in FIG. 9B may be same as the pixel area PA1 in FIG. 9A. However, the compensated active area AA2 in FIG. 9B, which may represent the active area AA1 after compensation occurs, may be different from the active area AA1 in FIG. 9A, which may represent the tilted active area AA1. The compensated spare area SA2 in FIG. 9B, which may represent the spare area SA1 after compensation occurs, may be different from the spare area SA1 in FIG. 9A, which may represent the tilted spare area SA1. The compensated spare area SA2 may be defined as an area surrounding or around a periphery of the compensated active area AA2.

The compensated spare area SA2 may include vertical compensated spare areas SAV1 and SAV2 corresponding to upper and lower portions of the compensated spare area SA2 and a horizontal spare area SAH that may not include the vertical compensated spare areas SAV1 and SAV2.

To deactivate spare pixels SPX in the vertical compensated spare areas SAV1 and SAV2, the spare pixels SPX in the vertical compensated spare areas SAV1 and SAV2 may be turned off. In contrast, to activate spare pixels SPX in the horizontal compensated spare area SAH, the spare pixels SPX in the horizontal compensated spare area SAH may be turned on and thus display a black image.

In a case that the gate signals may not be provided to the gate lines connected to the spare pixels SPX in the vertical compensated spare areas SAV1 and SAV2, the spare pixels SPX in the vertical compensated spare areas SAV1 and SAV2 may be turned off.

To deactivate the spare pixels in the vertical compensated spare areas SAV1 and SAV2, the gate driver 300 may output the gate signals from an uppermost portion VP2 of the compensated active area AA2 to a lowermost portion VP3 of the compensated active area AA2. For example, the gate signals from an uppermost portion VP1 of the pixel area PA2 to the uppermost portion VP2 of the compensated active area AA2 may be masked and the gate signals from the lowermost portion VP3 of the compensated active area AA2 to a lowermost portion VP4 of the pixel area PA2 may be masked. As another example, the vertical start signal of the gate driver 300 may be outputted to a stage of the gate driver 300 corresponding to the uppermost portion VP2 of the compensated active area AA2 to set a start point of scanning of the gate signal to the uppermost portion VP2 of the compensated active area AA2.

The spare pixels SPX in the horizontal compensated spare area SAH may be disposed adjacent to the compensated active area AA2 in the horizontal direction so that the gate signals may be applied to the spare pixels SPX in the horizontal compensated spare area SAH in a case that the gate signals may be applied to the pixels of the compensated active area AA2. Thus, the spare pixels SPX in the horizontal compensated spare area SAH may be turned on to display the black image, instead of being turned off.

The display panel 100 may include the spare area SA surrounding or around a periphery of the active area AA and the spare area SA may include the spare pixels SPX which may be selectively activated. Thus, a margin or amount of spare pixels SPX which may compensate the misalignment between the window and the active area may be obtained by using the spare pixels SPX of the spare area SA in a case that the window WD and the active area AA may not be aligned accurately.

Thus, a misalignment between the window WD and the active area AA may be compensated so that the reliability of the display apparatus may be enhanced and the number of the discarded display apparatuses overly affected by the misalignment may be minimized so that an overall manufacturing cost of the display apparatus may be reduced.

With respect to operational efficiency of the display apparatus, the spare pixels SPX in the vertical compensated spare areas SAV1 and SAV2 may be turned off instead of displaying the black image so that power consumption of the display apparatus may be further reduced.

Figure 10:
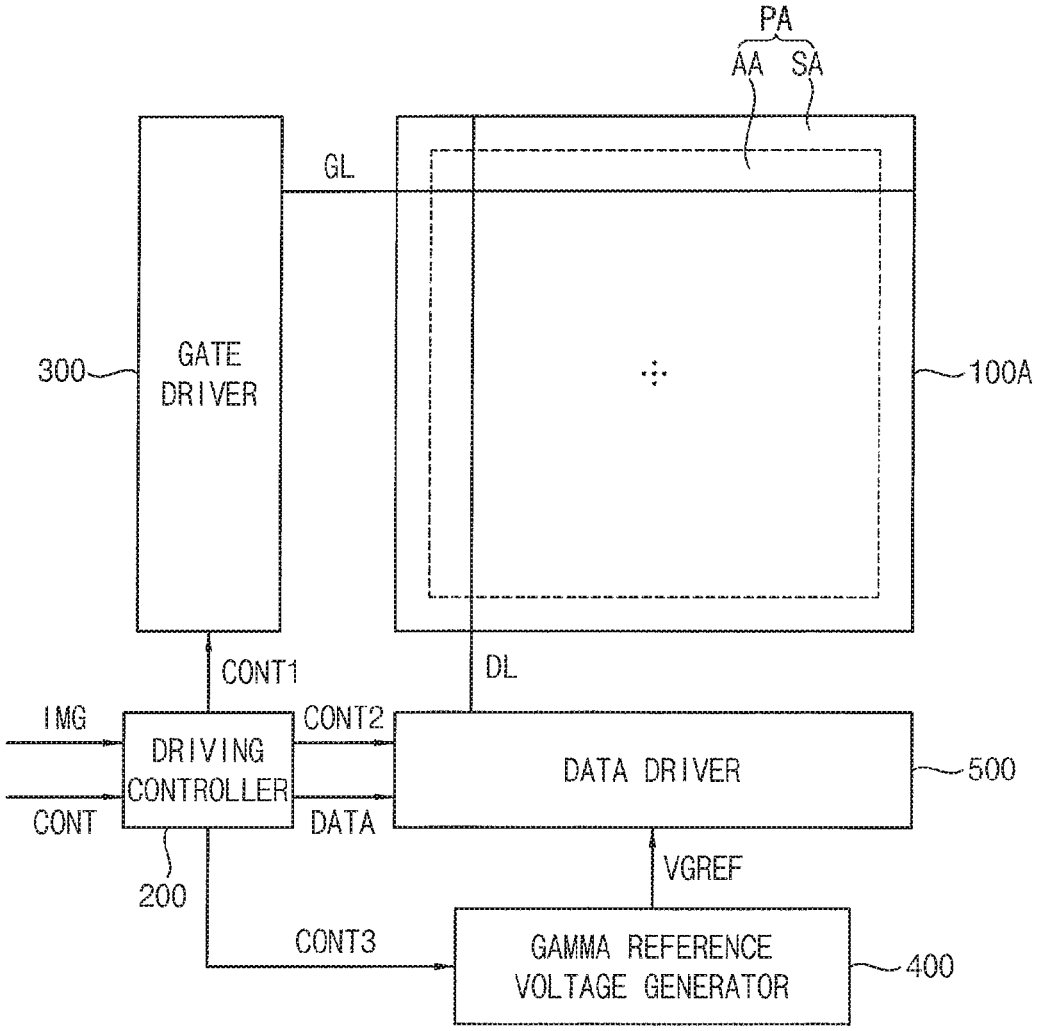
FIG. 10 shows a block diagram illustrating a display apparatus according to an embodiment.

FIG. 10 shows a block diagram illustrating a display apparatus according to an embodiment.

The display apparatus and the method of driving the display panel according to the embodiment may be substantially the same as the display apparatus and the method of driving the display panel of the embodiment of FIGS. 1 to 8B except for a shape of the display panel.

Referring to FIGS. 1 to 3, 5 to 8B and 10, the display apparatus may include a rectangular display panel 100A.

The display apparatus may include a window WD and the display panel 100A. A viewing area VA may be defined by the window WD.

The display panel 100A may include a pixel area PA. The pixel area PA may include an active area AA and a spare area SA surrounding or around a periphery of the active area AA. The active area AA may include the pixels PX. The spare area SA may include the spare pixels SPX.

The display apparatus may include the display panel 100A and the display panel driver. The display panel driver includes the driving controller 200, the gate driver 300, the gamma reference voltage generator 400 and the data driver 500.

The viewing area VA may include a rectangular shape. The active area AA may include a rectangular shape. The pixel area PA, which may represent a sum of the active area AA and the spare area SA, may include a rectangular shape. For example, an outermost line of each of the active area AA and the spare area SA may include a line of the rectangular shape.

The active area AA including the pixels PX may display an image. The amount of tilt of the active area AA may be determined based on a distance between the viewing area VA defined by the window WD and the active area AA where the image may be displayed. Based on the amount of tilt of the active area AA, the spare pixels SPX disposed in the spare area AA may be selectively activated.

Thus, the active area AA and the activated spare area SA may form the compensated active area (AA2 in FIG. 8B) which may be disposed in the viewing area VA.

The display panel 100A may include the spare area SA surrounding or around a periphery of the active area AA and may include the spare pixels SPX which may be selectively activated. Thus, a margin or an amount of spare pixels SPX to compensate the misalignment between the window and the active area may be obtained using the spare pixels SPX of the spare area SA in a case that the window WD and the active area AA may not be aligned accurately.

Thus, a misalignment between the window WD and the active area AA may be compensated so that the reliability of the display apparatus may be enhanced and the number of the discarded display apparatuses overly affected by the misalignment may be minimized so that an overall cost of manufacturing the display apparatus may be reduced.

Figure 11:
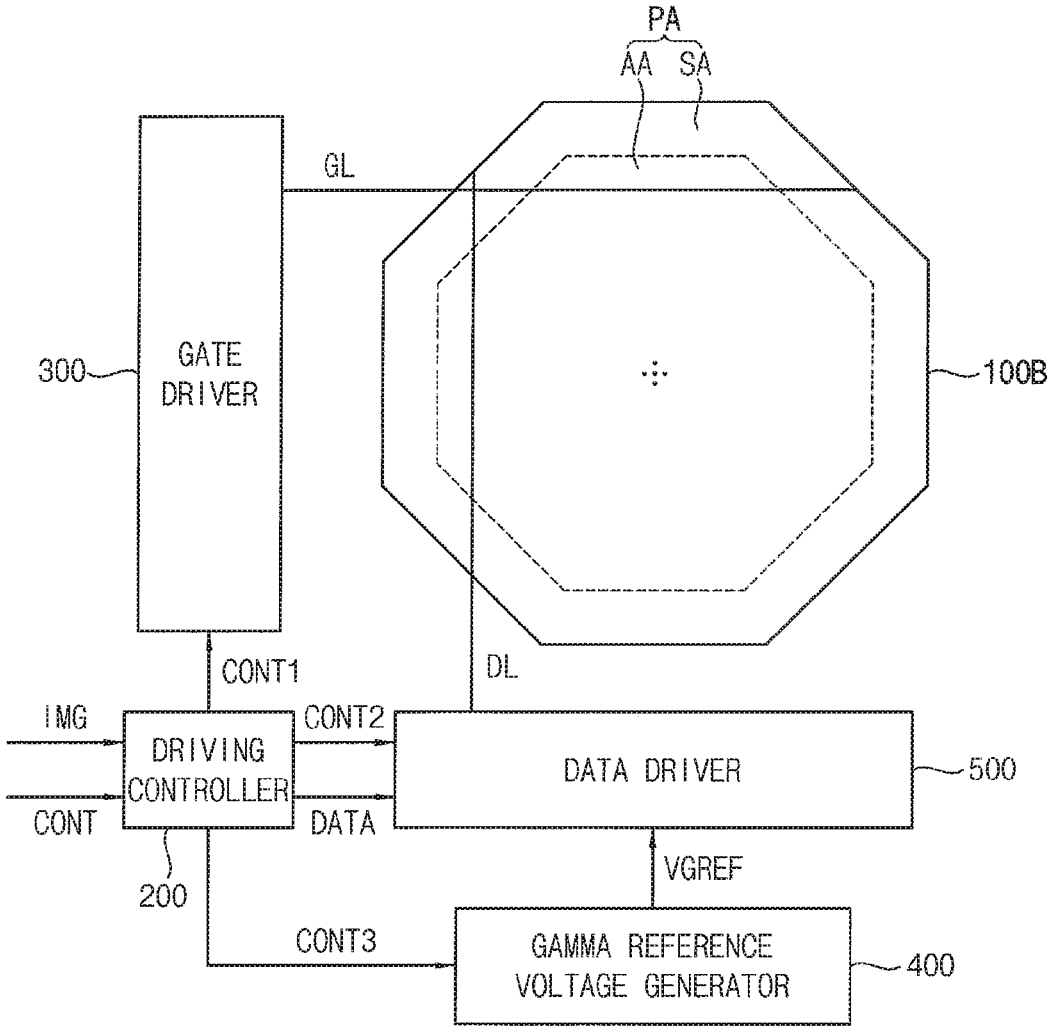
FIG. 11 shows a block diagram illustrating a display apparatus according to an embodiment.

FIG. 11 shows a block diagram illustrating a display apparatus according to an embodiment; and The display apparatus and the method of driving the display panel according to the embodiment may be substantially the same as the display apparatus and the method of driving the display panel of FIGS. 1 to 8B except for the shape of the display panel.

Referring to FIGS. 1 to 3, 5 to 8B and 10, the display apparatus may include a polygonal display panel 100B.

The display apparatus may include a window WD and the display panel 100B. A viewing area VA may be defined by the window WD.

The display panel 100B may include a pixel area PA. The pixel area PA may include an active area AA and a spare area SA surrounding or around the active area AA. The active area AA may include the pixels PX. The spare area SA may include the spare pixels SPX.

The display apparatus may include the display panel 100B and the display panel driver. The display panel driver may include a driving controller 200, a gate driver 300, a gamma reference voltage generator 400 and a data driver 500.

The viewing area VA may include a polygonal shape. The active area AA may include a polygonal shape. The pixel area PA, which may be a sum of the active area AA and the spare area SA, may include a polygonal shape. For example, outermost lines of the active area AA and the spare area SA may each be a line of the polygon.

Although the polygonal shape of the display panel 100B may be an octagon in FIG. 11, the embodiment may not be limited thereto. For example, the display panel 100B may have a polygonal shape of a square, a hexagon, a dodecagon, a chamfered square and so on.

The active area AA including the pixels PX may display an image. The amount of tilt of the active area AA may be determined based on a distance between the viewing area VA defined by the window WD and the active area AA where the image may be displayed. Based on the amount of tilt of the active area AA, the spare pixels SPX disposed in the spare area SA may be selectively activated.

Thus, the active area AA and the activated spare area SA may form the compensated active area (AA2 in FIG. 8B) which may be disposed in the viewing area VA.

According to the embodiment, the display panel 100B may include the spare area SA surrounding or around the active area AA and may include the spare pixels SPX which may be selectively activated. Thus, a margin or amount of the spare pixels SPX to compensate the misalignment between the window WD and the active area AA may be obtained using the spare pixels SPX of the spare area SA in a case that the window WD and the active area AA may not be aligned accurately.

Thus, a misalignment between the window WD and the active area AA may be compensated so that the reliability of the display apparatus may be enhanced and the number of the discarded display apparatuses overly affected by the misalignment may be minimized so that an overall cost of manufacturing the display apparatus may be reduced.

Figure 12:
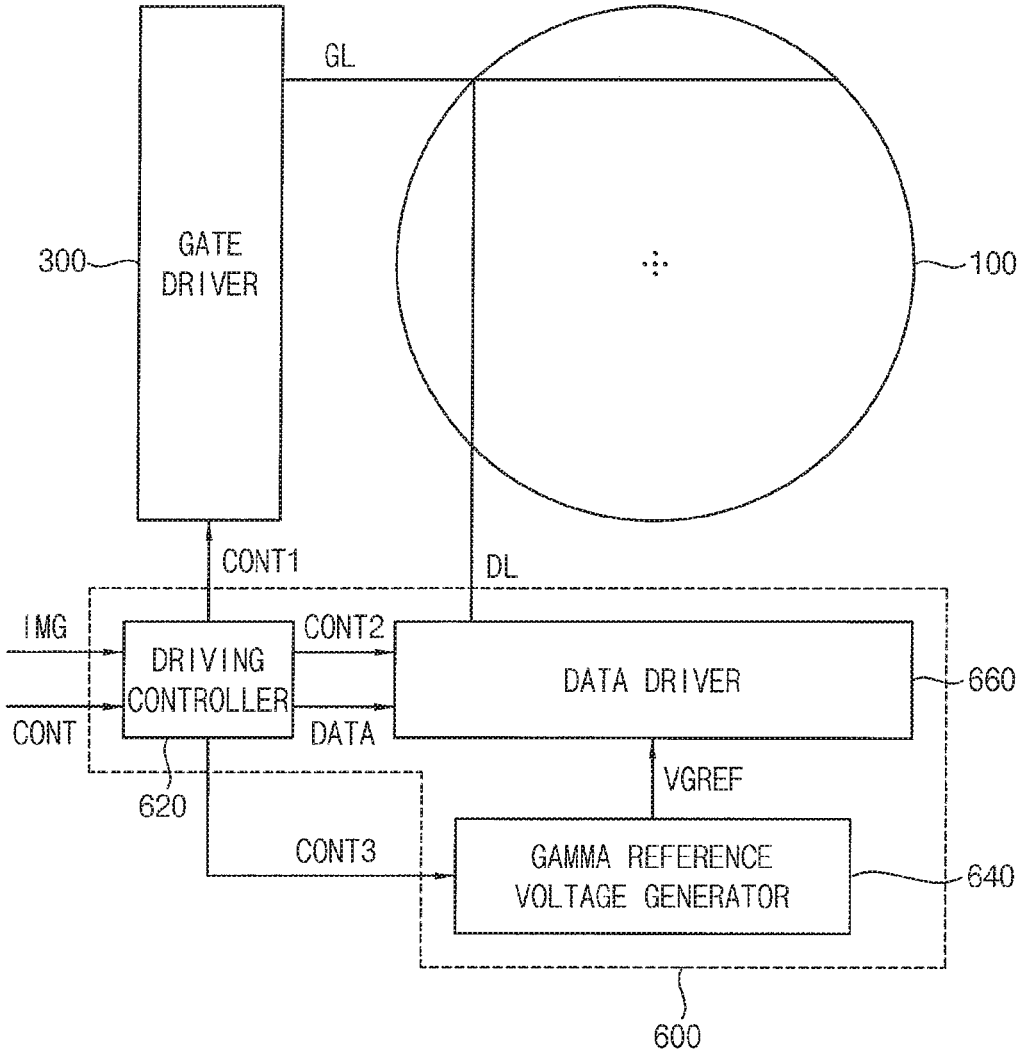
FIG. 12 shows a block diagram illustrating a display apparatus according to an embodiment.

FIG. 12 shows a block diagram illustrating a display apparatus according to an embodiment.

The display apparatus and the method of driving the display panel according to the embodiment may be substantially the same as the display apparatus and the method of driving the display panel of the embodiment of FIGS. 1 to 8B except for the structure of the display panel driver.

Referring to FIGS. 1 to 3, 5 to 8B and 12, the display apparatus may include a circular display panel 100 or a polygonal display panel 100.

The display apparatus may include a window WD and the display panel 100. A viewing area VA may be defined by the window WD.

The display panel 100 may include a pixel area PA. The pixel area PA may include an active area AA and a spare area SA surrounding or around a periphery of the active area AA. The active area AA may include of the pixels PX. The spare area SA may include the spare pixels SPX.

The display apparatus may include the display panel 100 and the display panel driver. The display panel driver may include the driving controller 620, the gate driver 300, the gamma reference voltage generator 640 and the data driver 660.

The driving controller 620 may generate the first control signal CONT1 for controlling an operation of the gate driver 300 based on the input control signal CONT, and may output the first control signal CONT1 to the gate driver 300.

The driving controller 620 may generate the second control signal CONT2 for controlling an operation of the data driver 660 based on the input control signal CONT, and may outputs the second control signal CONT2 to the data driver 660. The driving controller 620 may generate the data signal DATA based on the input image data IMG. The driving controller 620 may output the data signal DATA to the data driver 660.

The driving controller 620 may generate the third control signal CONT3 for controlling an operation of the gamma reference voltage generator 640 based on the input control signal CONT, and may output the third control signal CONT3 to the gamma reference voltage generator 640.

The gate driver 300 may generate gate signals driving the gate lines GL in response to the first control signal CONT1 received from the driving controller 620. The gate driver 300 may output the gate signals to the gate lines GL. For example, the gate driver 300 may sequentially output the gate signals to the gate lines GL.

The gamma reference voltage generator 640 may generate a gamma reference voltage VGREF in response to the third control signal CONT3 received from the driving controller 620. The gamma reference voltage generator 640 may provide the gamma reference voltage VGREF to the data driver 660.

The data driver 660 may receive the second control signal CONT2 and the data signal DATA from the driving controller 620, and may receive the gamma reference voltages VGREF from the gamma reference voltage generator 640. The data driver 660 may convert the data signal DATA into data voltages having an analog type using the gamma reference voltages VGREF. The data driver 660 may output the data voltages to the data lines DL.

The driving controller 620, the gamma reference voltage generator 640 and the data driver 660 may form an integrated driver 600. The integrated driver 600 may be an integrated circuit chip. The integrated driver 600 may be referred to a timing controller embedded data driver.

As another example, the driving controller 620 and the data driver 660 may be integrally formed and the gamma reference voltage generator 640 may be formed independently from the driving controller 620 and the data driver 660.

The active area AA including the pixels may display the image. The amount of tilt of the active area AA may be determined based on a distance between the viewing area VA defined by the window WD and the active area AA where the image may be displayed. Based on the amount of tilt of the active area AA, the spare pixels SPX disposed in the spare area AA may be selectively activated.

Thus, the active area and the activated spare area may form the compensated active area (AA2 in FIG. 8B) which may be disposed in the viewing area VA.

The display panel 100 may include the spare area SA surrounding or around the active area AA and may include the spare pixels SPX which may be selectively activated. Thus, a margin or amount of the spare pixels SPX to compensate the misalignment between the window and the active area may be obtained by using the spare pixels SPX of the spare area SA in a case that the window WD and the active area AA may not be aligned accurately.

Thus, a misalignment between the window WD and the active area AA may be compensated so that the reliability of the display apparatus may be enhanced and the number of the discarded display apparatuses overly affected by the misalignment may be minimized so that an overall cost of manufacturing the display apparatus may be reduced.

According to the of the display apparatus and the method of driving the display panel, a tilt defect between the window and the display panel may be compensated so that the reliability of the display apparatus may be enhanced and a manufacturing cost of the display apparatus may be reduced.

The foregoing is illustrative of the embodiments of the disclosure and is not to be construed as limiting thereof. Although the embodiments have been described herein, those skilled in the art will readily appreciate that many modifications are possible without materially departing from the novel teachings and advantages provided by the disclosure. Accordingly, all such modifications are intended to be included within the scope of embodiments as may be defined in the claims. In the claims, means-plus-function clauses are intended to cover the structures described herein as performing the recited function and not only structural equivalents but also equivalent structures.

What is claimed is:

1. A display apparatus comprising:

a window;

a display panel disposed beneath the window, and comprising an active area and a spare area surrounding the active area, the active area comprising pixels, and the spare area comprising spare pixels configured to be selectively activated; and a display panel driver configured to drive the display panel, wherein at least one selectively activated pixel is selected based on at least one of a vertical offset and a horizontal offset between a center of the active area and a center of a viewing area of the display panel, the viewing area being defined by the window, and the display panel shifts a center of the active area to the center of the viewing area of the display panel such that a displayed image is centered on the viewing area.

2. The display apparatus of claim 1, further comprising a light blocking portion disposed along the window and defining a viewing area of the display panel.

3. The display apparatus of claim 2, wherein the active area and an activated portion of the spare area form a compensated active area, and wherein the compensated active area is disposed in the viewing area of the display panel.

4. The display apparatus of claim 3, wherein a portion of the spare area is disposed outside of the viewing area of the display panel.

5. The display apparatus of claim 3, wherein the compensated active area is defined in response to the display panel being driven, and wherein the compensated active area is generated by activating the activated portion of the spare area forming the compensated active area to shift the active area in a horizontal direction and shift the active area in a vertical direction.

6. The display apparatus of claim 2, wherein the viewing area has a circular shape, the active area has a circular shape, and an area of the display panel comprising a sum of the active area and the spare area has a circular shape.

7. The display apparatus of claim 2, wherein the viewing area has a polygonal shape, the active area has a polygonal shape, and an area of the display panel comprising a sum of the active area and the spare area has a polygonal shape.

8. The display apparatus of claim 3, wherein the display panel driver is disposed outside of the spare area, and the display panel driver comprises a gate driver configured to output a gate signal to the display panel, and a data driver configured to output a data voltage to the display panel.

9. The display apparatus of claim 8, wherein a compensated spare area defining an area around the compensated active area is formed in response to formation of the compensated active area and configured to display a black image.

10. The display apparatus of claim 9, wherein the gate driver is configured to output the gate signal to the compensated active area and the compensated spare area, and the data driver is configured to output a target data voltage to the compensated active area and a black data voltage to the compensated spare area.

11. The display apparatus of claim 8, wherein a compensated spare area defining an area around the compensated active area comprises:

vertical compensated spare areas corresponding to upper and lower portions of the compensated spare area; and a horizontal spare area excluding the vertical compensated spare areas of the compensated spare area, wherein spare pixels in the vertical compensated spare areas are turned off, and spare pixels in the horizontal compensated spare area are turned on to display a black image.

12. The display apparatus of claim 11, wherein the gate driver is configured to output the gate signal from an uppermost portion of the compensated active area to a lowermost portion of the compensated active area.

13. A method of driving a display panel, comprising:

displaying an image in an active area, the active area comprising pixels;

determining a vertical offset and a horizontal offset between a center of the active area and a center of a viewing area of the display panel, the viewing area being defined by a light blocking portion disposed along a window around the viewing area;

selectively activating—at least one spare pixel of a plurality of spare pixels disposed in a spare area surrounding the active area based on at least one of the vertical offset and the horizontal offset; and shifting the center of the active area to the center of the viewing area of the display panel such that a displayed image is centered on the viewing area.

14. The method of claim 13, wherein the active area and an activated portion of the spare area form a compensated active area, and wherein the compensated active area is disposed in the viewing area.

15. The method of claim 14, wherein a portion of the spare area is disposed outside of the viewing area.

16. The method of claim 14, wherein the compensated active area is generated by activating the activated portion of the spare area forming the compensated active area to shift the active area in a horizontal direction and shift the active area in a vertical direction.

17. The method of claim 14, wherein a compensated spare area defining an area around the compensated active area is formed in response to formation of the compensated active area and configured to display a black image.

18. The method of claim 17, wherein a gate driver is configured to output a gate signal to the compensated active area and the compensated spare area, and a data driver is configured to output a target data voltage to the compensated active area and a black data voltage to the compensated spare area.

19. The method of claim 14, wherein a compensated spare area defining an area around the compensated active area comprises:

vertical compensated spare areas corresponding to upper and lower portions of the compensated spare area; and a horizontal spare area excluding the vertical compensated spare areas of the compensated spare area, wherein spare pixels in the vertical compensated spare areas are turned off, and spare pixels in the horizontal compensated spare area are turned on to display a black image.

20. The method of claim 19, wherein a gate driver is configured to output the gate signal from an uppermost portion of the compensated active area to a lower most portion of the compensated active area.

* * * * *